US007226042B2

(12) United States Patent
Cobden et al.

(10) Patent No.: US 7,226,042 B2
(45) Date of Patent: Jun. 5, 2007

(54) WINCH AND WINCH DRUM

(75) Inventors: Tony Cobden, Sussex (GB); Christopher Lesley Treagust, Hampshire (GB)

(73) Assignee: Lewmar Limited (GB)

( * ) Notice: Subject to any disclaimer, the term of this patent is extended or adjusted under 35 U.S.C. 154(b) by 0 days.

(21) Appl. No.: 11/113,458

(22) Filed: Apr. 25, 2005

(65) Prior Publication Data

US 2006/0006371 A1 Jan. 12, 2006

(30) Foreign Application Priority Data

Apr. 26, 2004 (GB) ..... 0409253.2

(51) Int. Cl.
*B66D 1/30* (2006.01)

(52) U.S. Cl. ..... 254/371; 254/266; 254/278; 242/613.2

(58) Field of Classification Search ..... 254/371, 254/266, 278, 374; 242/613.2
See application file for complete search history.

(56) References Cited

U.S. PATENT DOCUMENTS

| | | | | | |
|---|---|---|---|---|---|
| 23,499 | A | * | 4/1859 | Reed | 254/266 |
| 756,851 | A | * | 4/1904 | Hartweg | 226/193 |
| 4,274,606 | A | * | 6/1981 | Bernwall et al. | 254/266 |
| 4,688,765 | A | * | 8/1987 | Guangorena | 254/374 |
| 5,593,140 | A | * | 1/1997 | van Beers | 254/374 |
| 5,829,736 | A | * | 11/1998 | Harken | 254/278 |
| 5,947,451 | A | * | 9/1999 | Cavanagh | 254/374 |
| 6,019,353 | A | * | 2/2000 | Atfield | 254/278 |
| 6,435,480 | B1 | | 8/2002 | Allen | 254/371 |

* cited by examiner

*Primary Examiner*—Emmanuel Marcelo
*Assistant Examiner*—Evan Langdon
(74) *Attorney, Agent, or Firm*—St. Onge Steward Johnston & Reens LLC

(57) ABSTRACT

Disclosed is a winch drum for rotation about a rotation axis. The winch drum has a rope-receiving surface with a plurality of raised ridges defining substantially helical channels between them. The channels provide guidance for rope along the rope-receiving surface at least during rope release. The ridges have a meandering shape extending around the drum, formed from a series of alternating circumferential and axially inclined ridge elements.

14 Claims, 4 Drawing Sheets

WINCH AND WINCH DRUM

This application claims priority from pending Great Britain application number 0409253.2 filed Apr. 26, 2004.

FIELD OF THE INVENTION

The present invention relates to winches and winch drums, for example for use on sailboats such as yachts. Of particular interest are surface finishes of such winches and winch drums.

RELATED ART

Winches are commonly used in marine applications to control the length of or tension in a rope wound on the rotatable drum of the winch. An important feature of the winch drum of such a winch is the finish applied to the rope-gripping surface of the drum. Different types of finish produce different grip characteristics. However, because a given finish will usually cause rope wear, in practice the choice of a particular finish for a given application will often represent a compromise between grip and wear.

One known finish for a metallic winch drum is provided by shot-peening. In this process, ceramic grit shot particles are directed at high speed at the grip surface of the winch drum. Another known finish is provided by needle-peening. In this process, a set of reciprocating hardened needles is pressed against the drum surface. Both processes result in a random arrangement of relatively fine (in relation to the dimensions of the drum) peaks and dents on the grip surface of the winch drum.

Peened finishes provide good gripping characteristics and controlled letting-off of rope from the winch drum, but have a tendency to promote premature rope wear. In addition, the quality of the peened finish can be variable. That is, peened finishes are susceptible to variations caused by e.g. changes to the velocity and direction of the shot particles. Subsequent processing can also affect the finish. For example, chrome plating onto a peened brass surface will tend to "soften" the finish of the brass surface. Thus there are many factors which can make it difficult to maintain the reproducibility of peened finishes.

It is also difficult to quantify the essential parameters of any particular finish (meaning those parameters which determine grip and wear) because of the essentially random nature of the arrangement of peaks and dents. This can be a particular disadvantage if it is desired to investigate systematically the effects of different finishes on rope grip and rope wear, e.g. by varying systematically the parameters of the finish.

Another known finish consists of having an arrangement of vertical slots or ribs on the grip surface of the drum. The slots or ribs are generally parallel to the axis of rotation of the drum, i.e. perpendicular to the winding direction of the rope. However, the grip provided by this type of finish tends to be too strong so that when controlled release of the rope is attempted from the winch, large quantities of rope are let off at a time rather than an even, slow feed-off.

WO 00/12423 describes a winch drum having a rope-holding surface with a staggered array of pyramidal protuberances. The protuberances are arranged so that there is no true circular path around the surface of the drum, and the rope wound on it in the hoop direction is deflected sinusoidally. The machining process for providing the pyramidal protuberances is very complex, requiring generated shapes.

This requires a significant amount of programme and machine software processing time, and modern, complex machines.

SUMMARY OF THE INVENTION

The present invention aims to address one or more of the problems associated with known surface finishing techniques. It is a preferred object of the invention to provide a surface finish which exhibits one or more of the following:

1. Sufficient grip to pull a working load.
2. As little rope wear as possible.
3. Control of the rope when it is being released under high load.

Preferably, the present invention also aims to guide the rope around the drum in such a way as to avoid bunching of the rope loops at the top of the drum when the rope is being fed down the drum during rope release.

According to the present invention, there is provided, in a first aspect, a winch drum for rotation about a rotation axis, a rope-receiving surface of the drum having a plurality of raised ridges defining substantially helical channels between them, said channels providing guidance for rope along said rope-receiving surface at least during rope release.

Helical is used in this context to indicate a configuration where the axial position of a point in a channel in the drum surface changes as the point is moved along the channel around the drum. Preferably, the gradient of the helical channels is substantially constant.

The channels provide guideways for the rope as it is fed onto and off the drum. During rope let-off, the rope is guided down the drum by the channels, thereby avoiding bunching at the top of the drum. The channels need not extend the full axial extent of the rope-receiving surface of the drum. For example, the channels may be located at only one axial end of the drum. Alternatively, the channels may extend substantially across the axial extent of the rope-receiving surface of the drum. In that case, in use, the rope need not follow a single channel but may be guided between channels.

Preferably, two or more of said channels are not contiguous. In other words, the rope-receiving surface may have a plurality of channels each of which starts at a different radial point on the drum.

Preferably, each said channel is arranged to guide rope into a respective rope release guide means at an axial limit of the rope-receiving surface.

Preferably, each of said ridges has a meandering shape. The meandering shape may be formed from a series of alternating circumferential and axially inclined ridge elements.

Preferably, the axially inclined ridges are substantially parallel to one another to define channels of substantially uniform width.

Preferably, each channel has a concave shape. The smooth nature of the channels reduces rope wear resulting from sharp edges and prevents snagging of the rope on corners.

Preferably, each said channel has a plurality of gripping ribs extending across it between ridges on either side of the channel. The raised ribs provide grip for the rope on the rope-receiving surface. The surface of the channel between adjacent ribs may be concave to avoid rope wear on sharp edges. Both the ridges and ribs may be rounded.

Preferably, the ridges and ribs define a substantially regular axially staggered pattern of depressions. Preferably, the ribs are substantially parallel to one another to provide the depressions with a substantially uniform shape. Preferably, the ribs extend at an angle to the axial direction, i.e. they do not extend parallel to the rotational axis of the drum.

Preferably, the ridges and ribs define a regular axially staggered pattern of depressions. The depressions may tessellate to cover substantially all of the rope-receiving surface of the drum. A regular surface allows increased control because the surface grips in a uniform way.

To form the helical channels, the depressions preferably tessellate such that nearest-neighbour depressions in adjacent channels are axially displaced from one another. The ridges and ribs may form an interconnected grid. The depressions are preferably regular or irregular hexagons, but could be any other suitable polygonal tessellating shape.

Preferably, each of said ridges has a meandering e.g. wavy shape. The meandering shape may be formed from a series of alternating circumferential and axially inclined ridge elements, as set out above.

This configuration may give the channel a substantially zigzag shape. Therefore, in use, a rope wound around the drum preferably experiences mechanical pushing forces from the ridge elements. The zigzag shape dictates that more rope must contact the surface of the drum in a given rope loop, thereby further improving grip.

Preferably, ribs in neighbouring channels are offset from one another. Thus, each junction between a rib and a ridge may be at a separate point with no two ribs joining a ridge at the same point.

Preferably, each rib meets a ridge at a junction of an axially inclined ridge element with a circumferential ridge element.

The ridges may project further from the surface of the drum than the ribs. The ridges may provide mechanical gripping (e.g. through making the rope deviate) whereas the ribs may provide frictional gripping (e.g. by biting into the rope). Thus, it may be preferable to keep the height of the ribs small to prevent excess rope wear.

According to a second aspect of the present invention, there is provided a winch drum for rotation about a drum axis, a rope-receiving surface of the drum having a first portion with a smooth surface and a second portion with an undulating surface for assisting with gripping of the rope, there being an intermediate portion between the first and second portions that provides a graduated variation between a smooth surface at one side, adjacent the first portion, to an undulating surface at the opposite side, adjacent the second portion.

The inventors have found that this arrangement can advantageously assist in reducing rope wear. In particular, the first (smooth) portion may be located at the part of the drum onto which the rope is guided from the load. Typically, that is normally the lower end of the drum in use.

Preferably, the undulating surface is the arrangement of channels and raised ridges described with respect to the first aspect.

This second aspect of the invention may be combined with the first aspect of the invention, or any preferred or optional feature thereof.

BRIEF DESCRIPTION OF THE DRAWINGS

The present invention will now be described, by way of example, in relation to a specific embodiment and with reference to the drawings, in which.

DETAILED DESCRIPTION OF THE PREFERRED EMBODIMENTS

Figure 1:
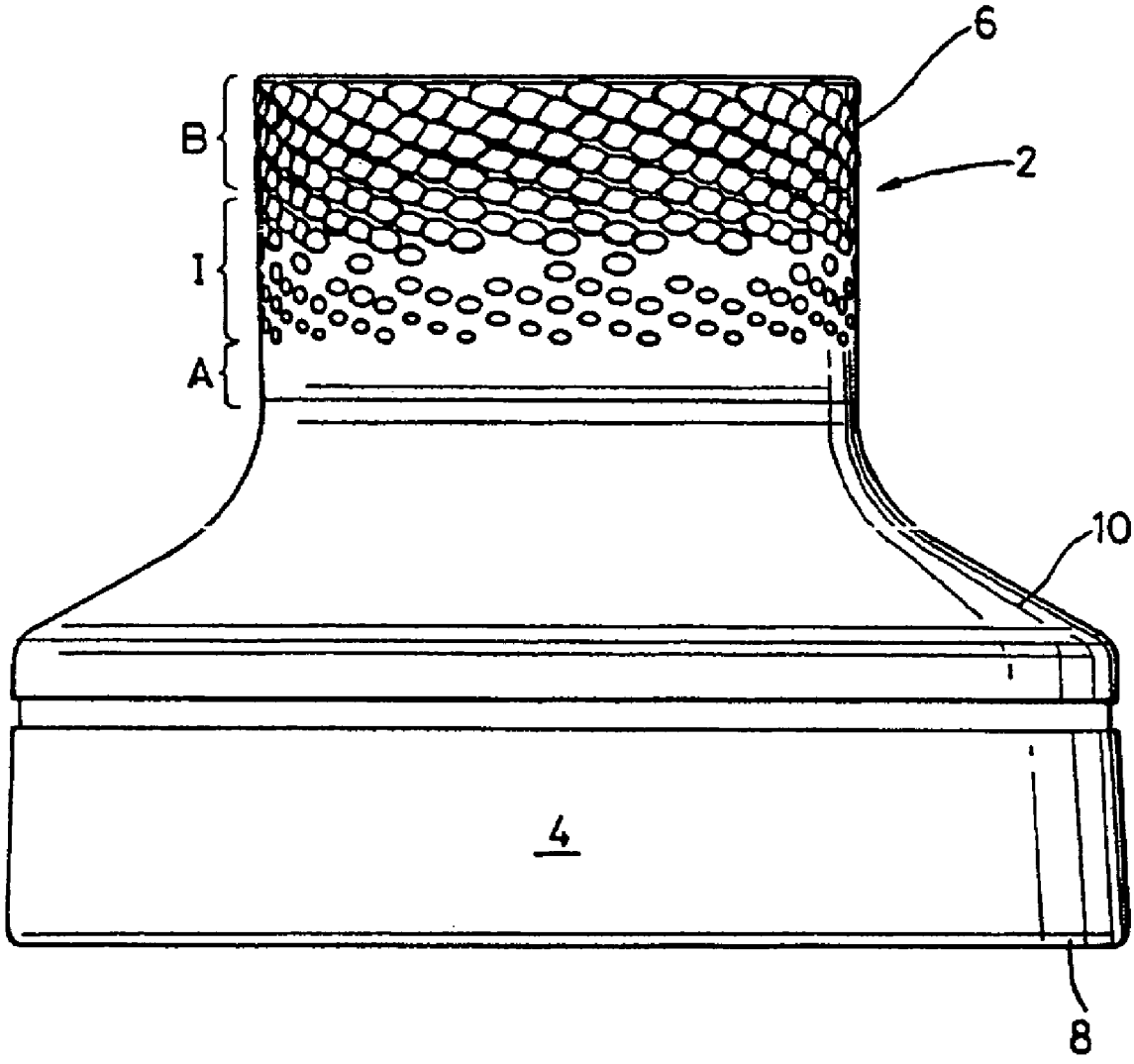
FIG. 1 shows a side view of a winch drum according to an embodiment of the invention.

FIG. 1 shows a winch drum 2 for rotatable mounting on a winch (not shown), the winch drum having a skirt 4 and a rope-gripping surface 6 positioned axially above a lower lip 10. In use, assembled on a winch, an upper lip part of the winch would be positioned axially above the winch drum. The rope-gripping surface is essentially cylindrical, of modified circular cross-section.

In use, a winch incorporating the winch drum 2 is secured by its base to a surface such as the deck of a yacht with the axis of rotation of the drum perpendicular to the surface, and a rope is wound around the rope-gripping surface, in single or (preferably) multiple loops, the lips preventing the rope from riding axially off the surface 6. Drive to rotate the drum can be applied from the head of the winch (not shown), or from below the deck in a known manner.

Figure 2:
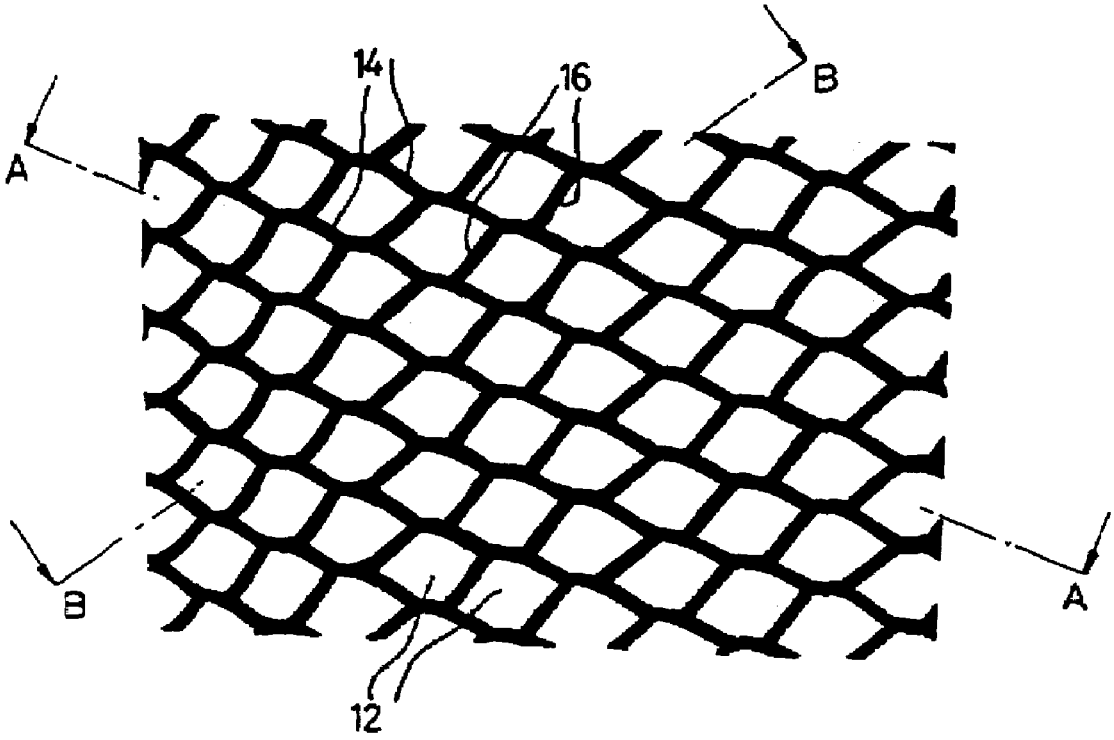
FIG. 2 shows a magnified view of part of the rope-gripping surface of the winch in FIG. 1.

The surface 6 of the upper portion of the drum has a finish which is shown in more detail in FIG. 2. The surface finish comprises helically extending projecting ridges 14 interconnected by upstanding ribs 16. The ridges 14 extend substantially parallel to one another to form helical channels which loop around the drum surface. The ribs 16 extend substantially at an acute angle less than perpendicular to the channel direction. The effect of the ridges 14 and ribs 16 is to produce a regular pattern of depressions 12. In FIG. 2 the pattern resembles a honeycomb structure or a fish-scale structure as the depressions tessellate closely with one another. The depressions are shown as hexagonal. The angle of the helix channels down the drum may be optimised to assist the feed of rope down the drum when, in use, rope is being let off.

Figure 3:
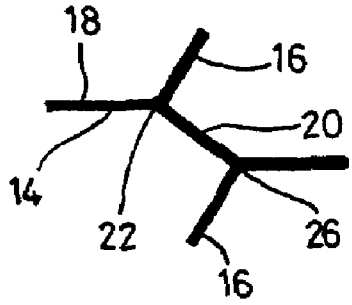
FIG. 3 shows a selected portion of the view of FIG. 2.

A basic unit of the structure is shown in FIG. 3. The ridges 14 comprise two parts: a circumferential ridge element 18, which is substantially perpendicular to the axis, and an axially inclined ridge element 20, which is inclined at an e.g. acute angle to the circumferential ridge element 18. Each inclined ridge element 20 is interposed between two circumferential ridge elements 18. This gives the ridge 14 a zig-zag shape. The zig-zag includes junctions 22, 26 between circumferential ridge elements 18 and inclined ridge elements 20. The junctions 22, 26 can be thought of as different in that junction 26 is a downwardly pointing junction, which points towards the base 4 of the winch drum, and in that junction 22 is an upwardly pointing junction, which points towards the top of the winch drum. Ribs 16 extend from junctions 22, 26 in the direction in which they point. In other words, ribs 16 from neighbouring junctions (22, 26) on a ridge 14 extend away from that ridge 14 in substantially opposite directions.

Figure 4A:
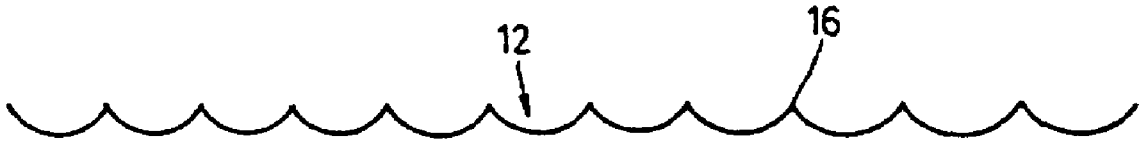
FIGS. 4*a* and 4*b* show a schematic transverse section of the rope-gripping surface taken along lines A—A and B—B in FIG. 2 respectively.
Figure 4B:
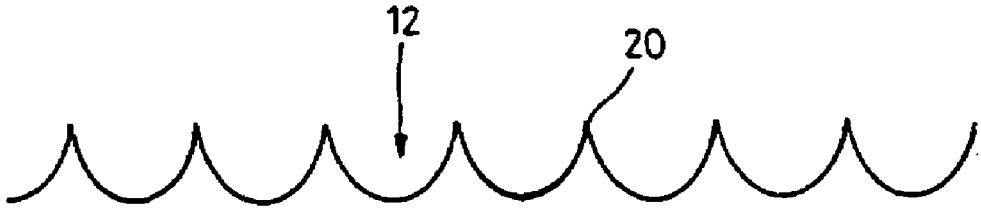

The ribs 16 do not project as far from the surface as the ridges 14. This can be seen in FIGS. 4*a* and 4*b*. Furthermore, the smooth continuous transition from one rib 16 or ridge 14 to the adjacent rib 16 or ridge 14 is also illustrated. Each depression therefore constitutes a smooth bowl with upstanding rim.

In FIG. 1, the lower end of the drum shows a gradual transition between the smooth part of the drum and the fully patterned part of the drum. First portion A of the drum surface has a smooth finish. Intermediate portion I of the drum surface has a graduated change in surface finish. Second portion B of the drum surface has a fully formed undulating surface, with the pattern described above with reference to FIGS. 2, 3, 4*a* and 4*b*.

The load on the rope is high at the lower end of the drum, and so a smooth drum surface avoids excessive rope wear. The gradual transition between the smooth surface and the fully patterned surface provided by the intermediate portion I allows the important combination of reduced rope wear with high rope grip.

As will be clear from the foregoing, the relative widths of the portions A, B and I can be selected according to the nature of the rope to be wound on the winch. For slippery ropes, it may be desirable to have only a short portion A and a short portion B, in order to maximise the grip between the rope and the winch.

In use, rope, e.g. from a load such as a sail, is wound on to the surface 6 of the drum from the bottom of the drum. The rope is guided upwards by the ridges 14, while the ribs 16 provide extra grip. The rope is deflected by the ridges in a zigzag pattern and snakes from channel to channel around the drum surface 6.

As a result of the surface finish, the gripping force on the rope is part frictional and part mechanical in origin (ignoring here rope-to-rope interactions). In contrast, the gripping force on a rope from a solely peened finish is almost entirely frictional, as the peaks and troughs of a solely peened finish are at least an order of magnitude smaller than a typical rope diameter. For this reason, wear of ropes running over such peened surfaces is much greater. Of course, superficial surface finishes may if desired be applied to the surface of the present drum.

By optimising the shape and dimension of the depression and/or channels, a surface finish can be arrived at that represents a good compromise between rope wear, grip and controlled let-off. That is, different shapes and dimensions of depressions and/or channels will be suitable for different sizes of winch and thicknesses of rope, but by adjusting these parameters in a systematic manner, the optimum finish for a given combination of winch and rope can be found.

Figure 5:
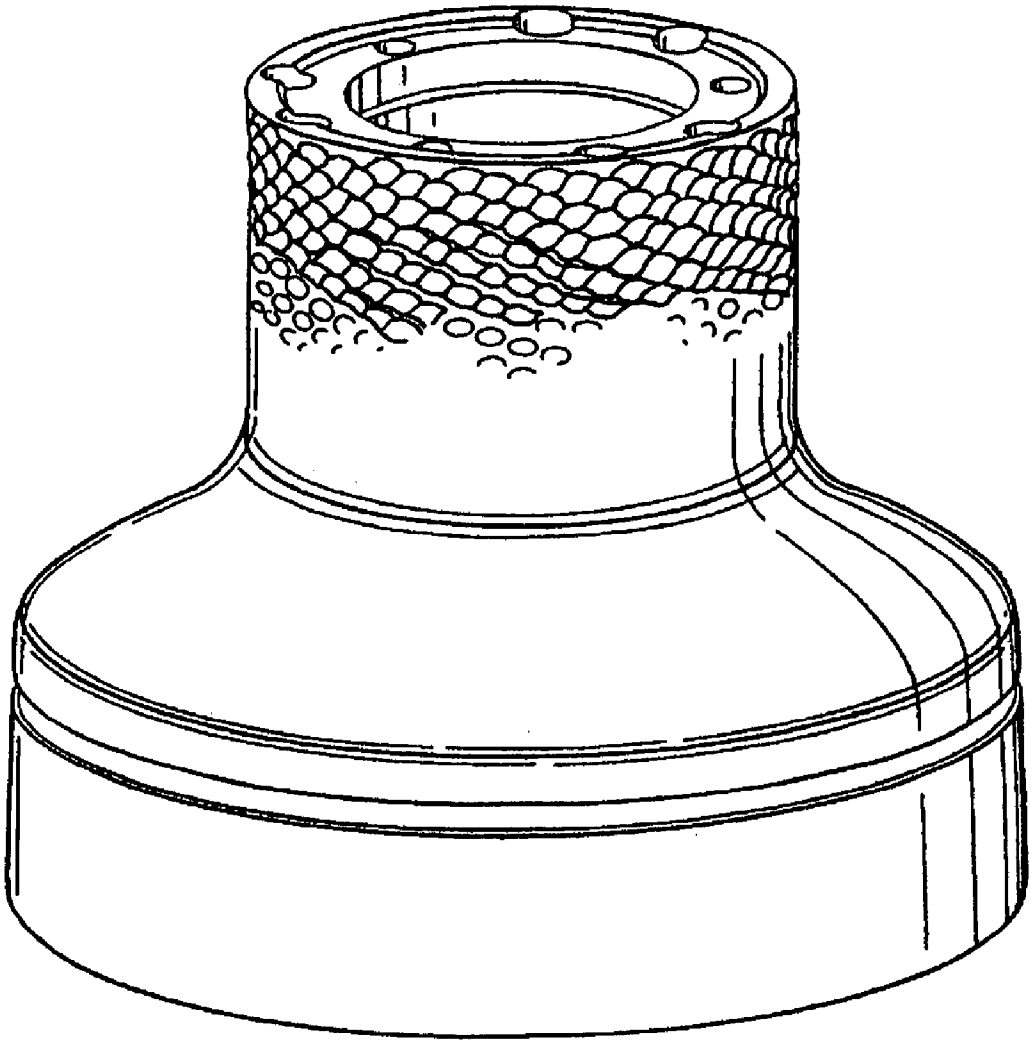
FIG. 5 shows a further side view image of a winch drum according to an embodiment of the invention.

FIG. 5 shows a computer-generated image of a winch drum according to an embodiment of the invention. This view shows the shape of the depressions and channels more clearly than in FIG. 1. FIGS. 1 and 5 show the intermediate portion of the drum as having depressions of reduced width compared to the second portion B. It is equally possible to have shallower depressions formed in the intermediate portion, of similar width to the depressions in the second portion B. In that case, it is the depth of the depressions that varies gradually along the intermediate portion I.

Known winch drum materials can be used for the winch drum described here. The machining for forming the pattern on the rope-receiving surface can be carried out using conventional machinery, using an appropriate relationship between the feed of the work and the speed of the tool, in a way that will be apparent to a skilled person on reading this disclosure.

The embodiment above has been described by way of example. Modifications of the embodiment, further embodiments and modifications thereof will be apparent to the skilled person on reading this disclosure and as such are within the scope of the invention.

What is claimed is:

1. A winch drum for rotation about a rotation axis, a rope-receiving surface of the drum having a plurality of raised ridges defining substantially helical channels between them, each of said ridges having a meandering shape extending around the drum, said meandering shape being formed from a series of alternating circumferential and axially inclined ridge elements, each said channel having a plurality of gripping ribs extending across said channel between adjacent ridges, said ridges projecting further from the surface of the drum than the gripping ribs, said channels providing guidance for rope along said rope-receiving surface at least during rope release.

2. A winch drum according to claim 1, wherein two or more of said channels are not contiguous.

3. A winch drum according to claim 1, wherein each said channel is arranged to guide rope into a respective rope release guide means at an axial limit of the rope-receiving surface.

4. A winch drum according to claim 1, wherein each channel has a curved concave profile.

5. A winch drum according to claim 1, wherein the surface of the channel between adjacent ribs is curved concave.

6. A winch drum according to claim 1, wherein the ridges and ribs define a regular axially staggered pattern of depressions.

7. A winch drum according to claim 6, wherein the depressions are regular or irregular hexagonal.

8. A winch drum according to claim 6, wherein the depressions tessellate such that nearest-neighbour depressions in adjacent channels are axially displaced with respect to each other.

9. A winch drum according to claim 1, wherein the ridges and ribs form an interconnected grid.

10. A winch drum according to claim 1, wherein each of said ridges has a meandering shape formed from a series of alternating circumferential and axially inclined ridge elements, and each rib meets a ridge at a junction of an axially inclined ridge element with a circumferential ridge element.

11. A winch drum according to claim 1, the rope-receiving surface of the drum having a first portion with a smooth surface and a second portion with the plurality of raised ridges defining substantially helical channels between them, there being an intermediate portion between the first and second portions that provides a graduated variation between a smooth surface at one side, adjacent the first portion, to an undulating surface at the opposite side, adjacent the second portion.

12. A winch incorporating a winch drum for rotation about a rotation axis, a rope-receiving surface of the drum having a plurality of raised ridges defining substantially helical channels between them, each of said ridges having a meandering shape extending around the drum, said meandering shape being formed from a series of alternating circumferential and axially inclined ridge elements, each said channel having a plurality of gripping ribs extending across said channel between adjacent ridges, said ridges projecting further from the surface of the drum than the gripping ribs, said channels providing guidance for rope along said rope-receiving surface at least during rope release.

13. A winch according to claim 12, which has a base for securing to a deck with the axis of rotation of the drum perpendicular to the deck.

14. A method of operating a winch having a winch drum for rotation about a rotation axis, a rope-receiving surface of the drum having a plurality of raised ridges defining substantially helical channels between them, each of said ridges having a meandering shape extending around the drum, said meandering shape being formed from a series of alternating circumferential and axially inclined ridge elements, each said channel having a plurality of gripping ribs extending across said channel between adjacent ridges, said ridges projecting further from the surface of the drum than the gripping ribs, said channels providing guidance for rope along said rope-receiving surface at least during rope release, wherein a rope is held on said rope-receiving surface, the method including turning the winch drum to feed one or more loops of the rope axially along the rope-receiving surface and guiding the rope off the rope-receiving surface under tension via said channels.

* * * * *